United States Patent [19]

Cherry

[11] 4,016,729

[45] Apr. 12, 1977

[54] CURB-DUCT FOR ROOF TOP AIR CONDITIONERS

[75] Inventor: Louis E. Cherry, Tulsa, Okla.

[73] Assignee: John Zink Company, Tulsa, Okla.

[22] Filed: Apr. 28, 1975

[21] Appl. No.: 572,272

[52] U.S. Cl. ..... 62/259; 62/DIG. 16

[51] Int. Cl.[2] ..... A25D 23/12

[58] Field of Search ..... 165/47, 53; 62/259, 62/DIG. 16

[56] References Cited

UNITED STATES PATENTS

| | | | |
|---|---|---|---|
| 2,638,757 | 5/1953 | Borgerd | 62/DIG. 16 |
| 2,682,757 | 7/1954 | Borgerd | 62/DIG. 16 |
| 2,817,217 | 12/1957 | Winkler et al. | 62/DIG. 16 |
| 3,415,073 | 12/1968 | Ammons | 62/259 |
| 3,500,655 | 3/1970 | Lyons | 62/259 |

*Primary Examiner*—Lloyd L. King
*Attorney, Agent, or Firm*—Head, Johnson & Chafin

[57] ABSTRACT

This invention describes an improved installation system for an air conditioning system which can be used for buildings, offices, or apartments usually where the roof is flat. It provides a shallow metal pan of cross-sectional area substantially that of the air conditioning equipment which is to be mounted on top of it. This pan is divided by a central wall into two plenums. There is an opening in the bottom of each plenum. The pan is mounted directly on the roof deck, and there is an appropriate opening in the roof deck immediately below the opening in the plenum. Means are provided for ducts to be connected between the openings in the plenums to extend through the roof to the ceiling of the room immediately below. A ceiling fixture, grill or diffuser is provided in the room, and the ducts are connected into the top of this ceiling fixture. Louvres in the ceiling fixture provide means for guiding returning air to the central grill of the fixture and for processed air to be distributed from the peripheral grills.

8 Claims, 3 Drawing Figures

CURB-DUCT FOR ROOF TOP AIR CONDITIONERS

BACKGROUND OF THE INVENTION

This invention lies in the field of moderately small air conditioning systems of the size of from 5 to 10 tons cooling capacity. It is used in buildings in which there is preferably a flat roof immediately above a living or working area, although the apparatus of this invention is adaptable to pitched roofs. In the prior art it was necessary to mount the air conditioning unit on the roof at the appropriate time during the construction of the building, after the deck was in place, and before the roof covering was installed. It was not always possible to have the electrical conduits in place or the various facilities required for the complete connection of the air conditioning system. This caused inefficiency and delay in the installation of the air conditioning equipment.

SUMMARY OF THE INVENTION

In this invention the need for dependence on other craftsmen for the installation of the air conditioning equipment is avoided. A base and support unit, called a curb, is provided which comprises a shallow sheet metal pan which is divided by a central wall into two chambers or plenums. The sheet metal is heavy enough to support the weight of the air conditioning unit which will later be mounted on top of it. The curb is fastened to the roof deck such as by bolting, and there is an appropriate opening under the curb, for the passage through the roof of two concentric ducts, or conduits, for air passage. The curb is mounted on the flat roof substantially vertically above the point at which the air distribution fixture is to be mounted in the ceiling of the room below. An appropriate hole is cut into the roof deck and the curb is mounted firmly to the roof.

With the curb mounted on the roof, the roofing operation can be completed. The roofing material is laid up against the side of the curb, which is designed to seal the ends of the roofing material. Later when the ceiling rails and channels are installed in the room below the roof, the diffuser, or ceiling fixture, is installed on the rails which have been provided, and are spaced suitably for the size of the ceiling fixture. The ceiling fixture is installed and the conduits are connected between the curb on the roof and the ceiling fixture.

The curb includes duct work which guides the return air from the central portion of the ceiling fixture, through the central duct to the first plenum, through the input to the air conditioning unit, to the second plenum, and through the second duct. The air goes then to distribution louvres on the periphery of the ceiling fixture, which blows the air downward and outward.

The air conditioning unit is then hoisted to the roof and placed on top of the curb and fastened thereto.

BRIEF DESCRIPTION OF THE DRAWINGS

It is a principal object of this invention to provide an installation device and system by which air conditioning units can be mounted on the roof above the rooms in which they are to be used, in which the installation is carried out in two steps: one in which the mounting device or curb is installed on the roof, after which craftsmen of all types can complete the building. Thereafter the air conditioning unit can be mounted on the previously installed mounting device, and the internal apparatus installed to complete the installation.

These and other objects of this invention and a better understanding of the principles and details of the invention will be evident from the following description taken in conjunction with the appended drawings, in which.

DESCRIPTION OF THE PREFERRED EMBODIMENT

Figure 1:
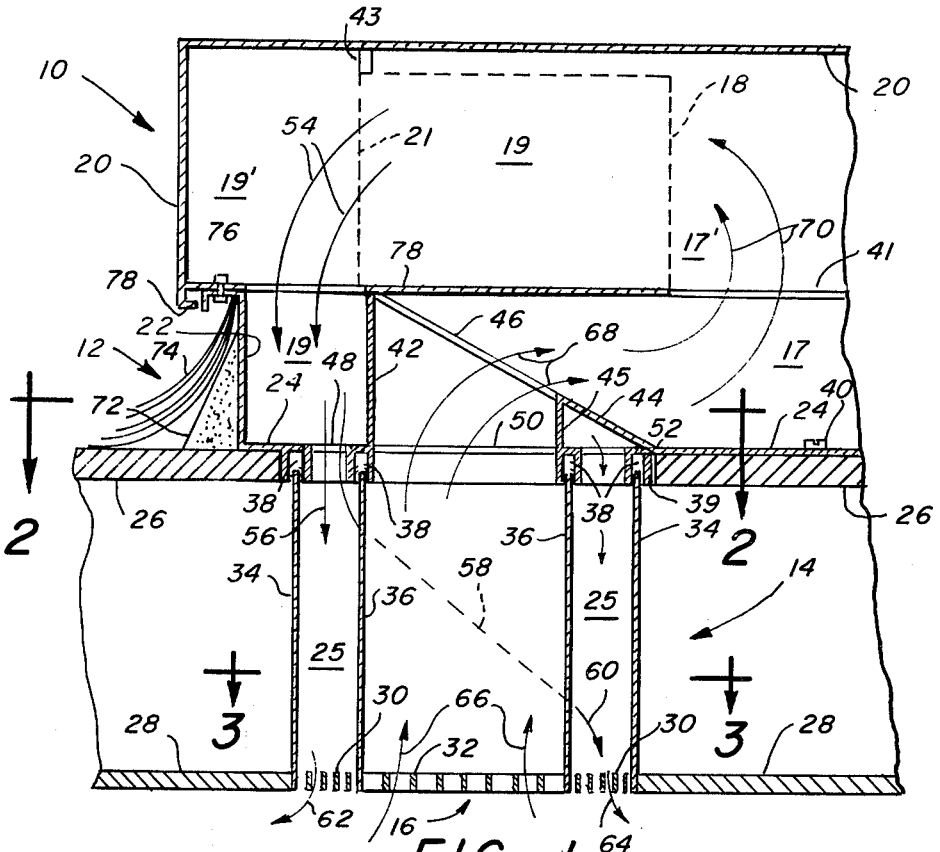
FIG. 1 represents a cross-sectional view of the entire installation comprising the curb, conduits and ceiling fixture.

Referring now to the drawings and in particular to FIG. 1, the numeral 10 indicates generally the air conditioning unit which is adapted to be mounted on top of the curb unit. The numeral 12 indicates generally the curb unit which is mounted on top of the roof deck. The numeral 14 indicates generally the conduits connecting the room ceiling fixture, or air diffuser, to the curb unit. Numeral 16 represents generally the ceiling fixture or air diffuser.

The curb unit 12 comprises a shallow pan or box with walls 22 and base 24 which is divided by a wall 42 into two plenums, one 17, for the return air, and the other 19, for the processed air. It also provides a suitable foundation for the mounting and attachment of the air conditioning unit 10 which will later be mounted on top of it. The curb also provides means for mounting the equipment to the roof deck such as by fastening means 40 to the roof deck 26, which may be of any suitable conventional construction. Also means are provided by the block means 72 surrounding the walls 22 of the curb unit against which the various layers of tar paper, felt, etc. 74 may be laid up against the walls 22 of the curb unit.

The sheet metal box which comprises the curb unit 12 can be installed on the roof deck at any time after the deck is in place and before the roofing material is installed. An appropriate opening 39 through the roof deck is provided through which the ducts 36 and 34 will pass. The opening is preferably cut before the curb is installed. Thereafter the building construction can be completed. At any time thereafter, the air conditioning unit 10 can be mounted on top of the curb and fastened by means of fasteners 76 of any suitable type.

The curb comprises a shallow box with a bottom surface 24 and side walls 22, with a central dividing wall 42, which breaks up the volume of the box into two parts forming two air plenum chambers. One of these, 17, is for the return air from the room below, while the other, 19, comprising the space between the wall 22 and the divider 42 is a plenum for the processed air from the air conditioning unit 18 in the housing 20, which is mounted on top of the curb unit.

Figure 3:
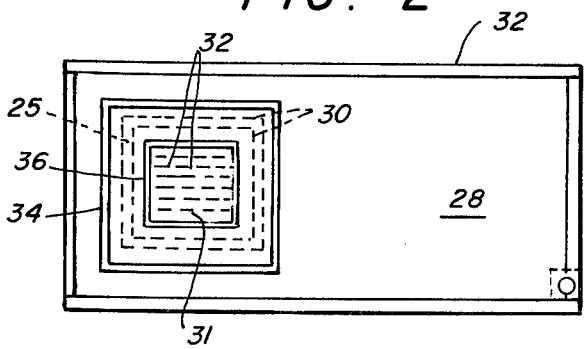
FIG. 3 represents a cross-section through the conduits along the plane 3—3.

Referring to FIG. 3 which is a cross-section taken along the plane 3—3 of FIG. 1, there are shown the two conduits 34 and 36, which are concentric square, or rectangular, conduits. These are made out of stiff, usually non-metallic material, e.g. bonded and sealed fiberglass, or equivalent material. They can be made from a long strip by scoring and bending the sheet into four walls, and the open edges are attached by means of plastic strips or other fastening means. The two concentric ducts are of a suitable dimension to fit the ceiling fixture, indicated generally by the numeral 16, which is adapted to fit within an opening in the ceiling 28 of the room in which the air conditioner is to be used. No details of fastening are provided because the art in this type of apparatus is well-known and commercial means are available for the positioning, fastening and mounting of the ceiling 28, and the diffuser or ceiling fixture 16.

While a complete illustration of the ceiling fixture or diffuser is not shown, a cross-section is shown in FIG. 1. It will have an overall dimension substantially that of the outer duct 34, which is fastened to the outer perimeter of the diffuser 16. The inner duct 36 is fastened to an inner portion of the diffuser and separates the area of the diffuser in such a way that processed air moves downward in accordance with the arrows 56, 58, 60, 62, 64 in the annular space between the two ducts, and out of the diffuser in the outer perimeter, in which the vanes, or louvers, are tilted so that the air flow is downward and outward in accordance with arrows 62 and 64. This downward flow of air into the room is provided through the four peripheral edges of the diffuser. The central portion of the diffuser, with the grill 32, is provided for the return air in accordance with arrows 66, 68 and 70. The returning air then flows upward through the opening 39 in the roof deck, and through the opening 50 in the bottom plate 24 of the curb unit 12, and up through an opening 46 in a sloping divider plate 44, that connects between the top edge of the wall 42 down to the bottom plate 24 along line 52. The returning air then flows in accordance with arrows 68 through the openings 50 and 46 into the plenum 17, and through an opening 41 in the base of the air conditioner 10, into a plenum 17' in the air conditioning unit. The returning air then flows through an inlet grill 18 into the air conditioning unit 19 where it is processed, and then flows out of a grill 21 in accordance with arrows 54 into the plenum 19' in the air conditioning unit, down into the plenum 19 in the curb unit, and then down through the opening 48 in the base 24 of the curb unit, and through the opening 39 in the roof deck, in accordance with arrows 56, 58, 60, 62, 64. The dashed arrow 58 is indicated to show that the processed air flowing down through plenum 19 flows through the opening 48 into the annular space 25 between the inner and outer ducts 36 and 34, respectively, and around the central duct 36 and down through the ceiling diffuser to the four external openings 30. The two openings 48, 50 in the base 24 of the curb are adjacent each other, but positioned so that 48 leads to the annular passage 25 while 50 leads from the central passage 31.

Figure 2:
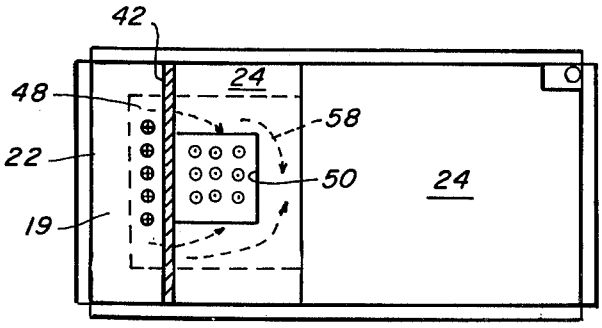
FIG. 2 represents a cross-section through the curb along the plane 2—2.

As seen in FIG. 2, the plenum 19 is of a rectangular shape, between the wall 22 of the curb unit and the wall 42, and terminates with the opening 48 through the base of the curb unit 24. The base 78 of the air conditioning unit fits the top of the wall 42 which completes the closure of the plenum 19. Also the portion of the plate 44 and the wall 45 close off the annular space 19 and therefore permits only the returning air 66 and 68 to pass into the plenum 17 to be reprocessed.

The base plate 24 of the curb unit has downwardly depending guide walls 38 into which are fitted the vertical rectangular conduits 34 and 36. Several inches of movement are provided so that any variation of the ceiling 28 from the roof deck 26 can be compensated by the conduits 34 and 36 sliding in the fixtures 38 which otherwise seal the air flow through the annular space 25 and the central space 31.

In operation, as soon as the roof deck has been installed and the appropriate opening 39 cut through the roof deck and a corresponding opening through the ceiling of the room immediately below to the roof, the curb is installed and fastened to the roof deck 26. A temporary plastic sheet cover can be used, which provides weather protection for the room below the opening 39. Thereafter no attention is required from the air conditioning personnel until the roof construction has been completed and the interior of the room below the air conditioning unit has been completed, and the rails which form the support for the ceiling are in place. Thereafter the temporary cover is removed from the curb. The ducts 34 and 36 are fastened to the ceiling diffuser 16 which is positioned in the opening of the hung ceiling, and the ducts 34 and 36 inserted into the appropriate grooves 38 which form part of the bottom plate of the curb unit. The ceiling diffuser is then locked in place in the ceiling 28.

The air conditioning unit 10 which can comprise a refrigerating and heating apparatus, as is well-known in the art, is then lifted to the roof and placed on top of the curb and fastened by means of bolts 76 as is well-known in the art. The air conditioning unit has a side wall 20 which has a depending lip 78 which serves further to seal the joint between the curb and the air conditioning unit against the weather.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. An air conditioning system adapted to receive and supply conditioned air from a roof top mounting opening to ceiling of a room below, comprising:

a. a rectangular shallow pan divided into two contiguous chambers one surrounding the other, means for sealable mounting said pan on said roof top, each of said chambers having at least one opening in the bottom thereof, the two opening together matching said mounting opening in said roof, conduit means extending from said chambers to said ceiling of said room;

b. means associated with said pan for supporting and fastening said air conditioning system to the top of said pan;

c. ceiling fixture means in said room, including air inlet means and air outlet means and including means to connect to each of said air inlet and outlet means one of said conduit means.

2. The system as in claim 1 in which:

said chambers comprise a rectangular shallow pan of sheet metal with a dividing wall to create said chambers.

3. The system as in claim 2, wherein said means for sealable mounting said pan comprises:

roofing material curved into the upstanding walls of said pan.

4. The system as in claim 1 in which:

said conduits are substantially rigid sheet material.

5. In a totally enclosed air conditioning system adapted for flat roof-top mounting, with provision for ducts for passage of air to and from said system from and to a ceiling fixture in a room immediately subadjacent and spaced below said roof top, the improvement comprising:

a. a double plenum means of sheet material mounted directly on said roof over at least one appropriate opening in said roof, and having upstanding walls;

b. means to support and fasten said air conditioning system on top of said walls;

c. at least two contiguous openings, surrounding each other, one in the bottom of each of said plenums and duct means operatively associated with each of said openings for carrying air to and from said plenums respectively;

d. ceiling fixture means in said room comprising air distribution means and air reception means, and including means to connect to each of said air distribution and air reception means one of said duct means.

6. The system as in claim 5 in which:

said duct means comprises substantially rigid walls forming two substantially concentric rectangular ducts, a smaller duct forming a conduit for returning air positioned inside the larger one, the annular space between the two ducts forming a conduit for processed air.

7. The system as in claim 5 in which:

said ceiling fixture means comprises a central rectangular grill for the passage to the central duct of returning air, and peripheral grill means, for passage of processed air from the annular conduit space between said two ducts.

8. The system as in claim 5, including:

means in said curb unit for separating a first plenum for passage of processed air to said annular conduit, from a second plenum for returning air from the inner duct.

* * * * *